United States Patent [19]

Ueda et al.

[11] Patent Number: 4,564,371

[45] Date of Patent: Jan. 14, 1986

[54] DISPERSANT FOR AQUEOUS SLURRY OF COAL

[75] Inventors: Tsunehisa Ueda, Zushi; Tadao Natsuume, Yokosuka, both of Japan

[73] Assignee: Nippon Zeon Co Ltd, Tokyo, Japan

[21] Appl. No.: 693,823

[22] Filed: Jan. 23, 1985

Related U.S. Application Data

[63] Continuation of Ser. No. 495,242, May 17, 1983, abandoned.

[30] Foreign Application Priority Data

May 17, 1982 [JP] Japan ..... 57-82934

[51] Int. Cl.[4] ..... C10L 1/18

[52] U.S. Cl. ..... 44/51; 406/197; 252/355

[58] Field of Search ..... 44/51, 66, 71, 76; 252/355; 406/197

[56] References Cited

U.S. PATENT DOCUMENTS

| | | | |
|---|---|---|---|
| 3,039,870 | 6/1962 | Laakso et al. | 525/327.8 |
| 3,412,023 | 11/1968 | Zuraw et al. | 252/355 |
| 3,417,061 | 12/1968 | Beerman et al. | 252/355 |
| 4,126,276 | 11/1978 | Manfroy et al. | 241/16 |
| 4,136,830 | 1/1979 | Manfroy et al. | 241/16 |
| 4,162,045 | 7/1979 | Klimpel et al. | 241/16 |
| 4,325,708 | 4/1982 | Bagnetto, Jr. | 44/66 |

FOREIGN PATENT DOCUMENTS 1246953 9/1971 United Kingdom .

*Primary Examiner*—William R. Dixon, Jr.
*Assistant Examiner*—Margaret B. Medley
*Attorney, Agent, or Firm*—Sherman & Shalloway

[57] ABSTRACT

A dispersant for an aqueous coal slurry, comprising as an active ingredient a water-soluble salt of a polymeric substance having a sulfonic acid residue bonded through an acid imide linkage or an acid amide linkage in the molecule.

11 Claims, No Drawings

DISPERSANT FOR AQUEOUS SLURRY OF COAL

This application is a continuation of application Ser. No. 495,242, filed May 17, 1983 now abandoned.

This invention relates to a novel dispersant for use in an aqueous slurry of coal powder, and a composition comprising an aqueous slurry of coal and the dispersant. More specifically, this invention pertains to a novel dispersant which enables the preparation of an aqueous slurry of coal in a high concentration, and to a composition comprising an aqueous slurry of coal and the dispersant.

The enormous increase in the price of petroleum in recent years gave impetus to effective utilization of coal. One significant problem with coal is that because of being solid, it lends itself to difficult transportation. In order to solve this problem, a measure has been under consideration to powderize coal, disperse it in water, and transport it as an aqueous coal slurry (to be sometimes referred to hereinbelow as ACS), and to some extent, this method has come into practical operation. According to this method, the concentration of coal must be made high if it is desired to increase the efficiency of transportation and the efficiency of combustion. On the other hand, as the concentration of coal increases, the viscosity of the slurry increases and its flowability is reduced. To provide a compromise between these contradictory matters a dispersant is usually added to ACS.

Specific examples of such dispersants known in the art include a naphthalenesulfonic acid/formaldehyde condensate, polyacrylic acid salts, polyoxyalkyl ether sulfates, olefin maleic acid copolymer salts, salts of copolymers of (meth)acrylic acid and vinyl comonomers, and salts of an acrylic acid/maleic acid copolymer (see, for example, Japanese Laid-Open Patent Publication Nos. 20090/1981, 57889/1981, 57890/1981, and 57891/1981).

These known dispersants cannot be said to have satisfactory dispersibility and storage stability and are not entirely suitable for ACS of high concentrations.

It is an object of this invention to remove such defects of the prior art.

The present inventors made extensive investigations in order to achieve this object, and have found that a water-soluble salt of a polymeric substance having a sulfonic acid residue introduced thereinto by a special mode of bonding has an excellent ability to disperse coal powder.

Thus, according to this invention, there is provided a dispersant for ACS comprising as an active ingredient a water-soluble salt of a polymeric substance having in the molecule a sulfonic acid residue bonded through an acid imide linkage or an acid amide linkage.

The polymeric substance used in this invention contains a sulfonic acid residue bonded through an acid imide linkage or an acid amide linkage in the molecule. The polymeric substance usually has a molecular weight of 500 to 100,000, preferably 1,000 to 50,000, and is a monopolymer or copolymer composed of (A) 2 to 100 mole%, preferably 5 to 100 mole%, of a sulfonic acid-type monomer, (B) 0 to 98 mole%, preferably 0 to 95 mole%, of an unsaturated carboxylic acid-type monomer, and (C) 0 to 90 mole%, preferably 0 to 60 mole%, of another vinyl-type monomer.

The sulfonic acid-type monomer (A) denotes an imide, half amide or amide of an unsaturated acid which has a sulfonic acid residue bonded through an acid imide linkage or an acid amide linkage (i.e., a sulfo group or a sulfonate group). Specific examples of the sulfonic acid-monomer (A) are imides, half amides or amides which are derived from $\alpha,\beta$-unsaturated mono- or di-carboxylic acids such as acrylic acid, methacrylic acid, crotonic acid, maleic acid, itaconic acid, fumaric acid or citraconic acid, and amino-containing sulfonic acids such as sulfamic acid, aminomethanesulfonic acid, aminoethanesulfonic acid, methylaminoethanesulfonic acid, amino-2-methylpropanesulfonic acid, aminobutanesulfonic acid, anilinemonosulfonic acid, anilinedisulfonic acid, aminotoluenesulfonic acid, naphthylaminemonosulfonic acid, naphthylaminedisulfonic acid or naphthylaminetrisulfonic acid or amino-containing sulfuric acid esters such as aminoethylsulfuric acid esters, aminopropylsulfuric acid esters, aminobutylsulfuric acid esters, aminohexylsulfuric acid esters and aminooctylsulfuric acid esters.

The unsaturated carboxylic acid-type monomer (B) denotes an unsaturated monomer having a carboxyl group or an acid anhydride group. Specific examples include $\alpha,\beta$-unsaturated dicarboxylic acids such as maleic acid, fumaric acid and itaconic acid, and $\alpha,\beta$-unsaturated dicarboxylic acid anhydrides such as maleic anhydride, itaconic anhydride and citraconic anhydride.

The other vinyl monomer (C) denotes radical-polymerizable vinyl monomers other than the aforesaid vinyl monomers. Specific examples are polar or non-polar vinyl monomers such as ethylene, propylene, butene, pentene, hexene, octene, decene, cyclopentene, cyclohexene, styrene, vinyltoluene, $\alpha$-methylstyrene, coumarone, indene, vinyl ether, ethyl acrylate, methyl methacrylate, acrylamide, acrylonitrile and vinyl acetate.

The polymeric substances used in this invention are not restricted by the method of production, and can be produced by customary methods. As required, a salt of the polymeric substance can be directly produced. Specific examples of such methods are (1) a method comprising polymerizing the sulfonic acid-type monomer with or without the other monomers; (2) a method comprising amidating a carboxylic acid-type polymer having a carboxyl group or an acid anhydride group, and reacting the product successively with formaldehyde and a bisulfite; (3) a method which comprises reacting a carboxylic acid-type polymer having an acid anhydride group with an amino-containing sulfonic acid or a sulfonic acid ester in a non-aqueous system (U.S. Pat. No. 3,039,870); (4) a method which comprises reacting a carboxylic acid-type polymer having an acid anhydride group with a salt of an amino-containing sulfonic acid or a sulfonic acid ester in the presence of water at high temperatures, thereby forming sulfonate salt of the polymer directly (British Pat. No. 1,246,953); (5) a method which comprises converting a carboxylic acid-type polymer having a carboxyl group into a polymer having an acid halide group, and reacting it with an amino-containing sulfonic acid or a sulfonic acid ester; and (6) a method which comprises treating an acid amide-type polymer having an acid amide group in the same way as in the method (2).

In the present invention, a water-soluble salt of such a polymeric substance is used as an active ingredient of dispersants for ACS. The salt of the polymeric substance may be one in which at least a part, preferably at least 50 mole%, of the sulfonic acid residue present in the molecule and the carboxyl and/or acid anhydride group optionally present forms a salt. Specific examples of the salt are salts of alkali metals or alkaline earth metals such as sodium, potassium, magnesium, calcium or barium, ammonium salts and amine salts. Of these, the alkali metal salts are preferred.

There is no particular restriction on the method of producing the salt of such a polymeric substance. There can be used a method of synthesizing the salt directly, as described above, without going through the form of the sulfonic acid or sulfonate of the polymer, and a method which comprises synthesizing the sulfonic acid or sulfonate of the polymer and thereafter neutralizing the product with a a base in a customary manner.

The dispersant for ACS of this invention may be in the form of a solid or an aqueous solution so long as it contains the aforesaid salt of the polymeric substance as an active ingredient. For ease of handling, it is usually employed in the form of an aqueous solution having a solids concentration of 10 to 50% by weight. Additives such as other dispersants, antifoamers and thickeners may be mixed with the dispersant of this invention in amounts which do not essentially reduce the effects of this invention.

The proportion of the dispersant used to prepare ACS varies depending upon the type, particle diameter and particle size distribution of coal, and the concentration of the coal in the slurry, etc. When an aqueous coal slurry having a concentration of 50 to 90% by weight, especially 60 to 80% by weight, is to be prepared, the amount of the dispersant used is 0.1 to 5 parts by weight, preferably 0.3 to 1 part by weight, per 100 parts by weight of coal.

The use of the dispersant of this invention makes it possible to reduce the viscosity of ACS drastically and to prepare ACS having excellent flowability and storage stability. Thus, the concentration of coal can be made higher, and the viscosity of ACS can be made lower, than in the case of using other dispersants.

The following Examples illustrate the present invention more specifically.

All parts and percentages in these examples are by weight unless otherwise specified.

The method of preparing the coal slurry, the method of testing it and the method of preparing samples are as follows:

METHOD OF PREPARING THE SLURRY

An aqueous solution of each of various dispersants was put in a HOBART mixer (manufactured by Maekawa Testing Materials Co., Ltd.), and with stirring at a low speed, a predetermined amount of coal powder (coal occurring in Australia; more than 75% 200 mesh through) was gradually added. After adding all the amount of coal, it was dispersed at a high speed. Then, by means of a homogenizer (manufactured by Tokushu Kika Kogyo Co., Ltd.), at 3000 rpm, it was further dispersed for 5 minutes. The properties of the resulting slurry were tested by the following methods.

Testing methods (1) Viscosity

Measured by a Brookfield viscometer at 12 rpm and 25° C.

(2) Flowability

The slurry was put in a glass funnel with a diameter of 60 mm, and the time required for 50 cc of the slurry to drop was measured. The results were evaluated as follows:

O: less than 5 minutes

Δ: 5 to 8 minutes

X: more than 8 minutes (3) Stability

The slurry was left to stand for one day, and the state of sediment formation was observed, and evaluated as follows:

O: No sediment

Δ: Some sediment

X: Sediment formed in layer

METHOD FOR SAMPLE PREPARATION (1) Sample 1

An autoclave was charged with 154 parts of an isobutylene/maleic anhydride copolymer (mole ratio 1:1; sample A) having a molecular weight of 40000, 148 parts of sodium aminoethanesulfonate (100 mole% based on the maleic anhydride portion of the copolymer) and 700 parts of water, and they were reacted with stirring at 180° C. for 5 hours to sulfonate the copolymer. The resulting aqueous solution was neutralized with sodium hydroxide to form an aqueous solution of the sulfonate of the polymer.

(2) Samples 2 to 5

Samples 2 to 5 were obtained in the same way as in the preparation of sample 1 except that aminomethanesulfonic acid, anilinesulfonic acid, anilinedisulfonic acid, and a sodium salt of β-aminoethylenesulfonate were used respectively as the sulfonating agent.

(3) Samples 6 to 9

Samples 6 to 9 were obtained in the same way as in the preparation of sample 1 except that maleic anhydride polymer (molecular weight 3000; sample B), ethylene/maleic anhydride copolymer (molecular weight 8000; mole ratio 1:1; sample C), isoamylene-maleic anydride copolymer (molecular weight 6000; mole ratio 1:1; sample D), and diisobutylene/maleic anhydride copolymer (molecular weight 4000; mole ratio 1:1; sample E) were used respectively instead of the isobutylene/maleic anhydride copolymer.

(4) Sample 10

168 parts of isoamylene/maleic anhydride copolymer (molecular weight 6000; mole ratio 1:1; sample F) was dissolved in 300 parts of acetone and then ammonia gas was blown into the solution to amidate the copolymer. After the reaction, the acetone was removed by concentrating the reaction mixture under reduced pressure. The resulting amidated product was dissolved in water to form a 30% aqueous solution. Then, 81 parts of 37% formalin and 107 parts of sodium bisulfite were added to the aqueous solution, and they were reacted at 70° C. to form a sulfomethylated product of the copolymer.

(5) Samples 11 to 14

Samples 11 to 14 were obtained in the same way as in the preparation of sample 2 or 3 except that aminomethanesulfonic acid or anilinesulfonic acid was used as the sulfonating agent in varying amounts.

EXAMPLE 1

Aqueous slurries of coal having a concentration of 70% were prepared by using 30% aqueous solutions of samples 1 to 5. The amount of each dispersant (active ingredient) added was 0.8%. The properties of these slurries were tested.

For comparison, the same tests were conducted on unmodified sodium salt of isobutylene/maleic anhydride copolymer (sample A).

The results are shown in Table 1.

TABLE 1

| Run No. | Invention 1-1 | 1-2 | 1-3 | 1-4 | 1-5 | Control 1-6 |
|---|---|---|---|---|---|---|
| Sample (Starting material) | Sample 1 (Sample A) | Sample 2 (Sample A) | Sample 3 (Sample A) | Sample 4 (Sample A) | Sample 5 (Sample A) | Sample A (–) |
| Sulfonating agent | Aminoethane-sulfonic acid | Aminomethane-sulfonic acid | Aniline-sulfonic acid | Aniline-disulfonic acid | Sodium salt of β-amino-ethylsulfate | – |
| Immediately after dispersion | | | | | | |
| Slurry viscosity (cps) | 1050 | 1300 | 950 | 1100 | 1020 | >20,000 |
| Flowability | O | O | O | O | O | X |
| After standing for one day | | | | | | |
| Slurry viscosity (cps) | 1050 | 1250 | 930 | 1120 | 1100 | >20,000 |
| Flowability | O | O | O | O | O | X |
| Stability | O | O | O | O | O | – |

EXAMPLE 2

Example 1 was repeated using 30% aqueous solutions of samples 6 to 9 instead of samples 1 to 5. For comparison, the properties of unmodified sodium salt of maleic anhydride polymer (sample B), sodium salt of ethylene/maleic anhydride copolymer (sample C), sodium salt of isoamylene-maleic anhydride copolymer (sample D) and sodium salt of diisobutylene/maleic anhydride copolymer (sample E) were evaluated in the same way. The results are shown in Table 2.

TABLE 2

| Run No. | Invention 2-1 | 2-2 | 2-3 | 2-4 | Control 2-5 | 2-6 | 2-7 | 2-8 |
|---|---|---|---|---|---|---|---|---|
| Sample (Starting material | Sample 6 (Sample B) | Sample 7 (Sample C) | Sample 8 (Sample D) | Sample 9 (Sample E) | Sample B (–) | Sample C (–) | Sample D (–) | Sample E (–) |
| Immediately after dispersion | | | | | | | | |
| Slurry viscosity (cps) | 1250 | 1300 | 1000 | 1120 | >20,000 | >20,000 | >20,000 | >20,000 |
| Flowability | O | O | O | O | X | X | X | X |
| After standing for one day | | | | | | | | |
| Slurry viscosity (cps) | 1200 | 1250 | 980 | 1100 | >20,000 | >20,000 | >20,000 | >20,000 |
| Flowability | O | O | O | O | X | X | X | X |
| Stability | O | O | O | O | – | – | – | – |

EXAMPLE 3

Example 1 was repeated using a 30% aqueous solution of sample 10. For comparison, the same test was conducted on unmodified sodium salt of isoamylene-maleic anhydride copolymer (sample F). The results are shown in Table 3.

TABLE 3

| Run No. | Invention 3-1 | Control 3-2 |
|---|---|---|
| Sample (Starting material) | Sample 10 (Sample F) | Sample F (–) |
| Immediately after dispersion | | |
| Slurry viscosity (cps) | 1,400 | >20,000 |
| Flowability | O | X |
| After standing for one day | | |
| Slurry viscosity (cps) | 1,400 | >20,000 |
| Flowability | O | X |
| Stability | O | – |

EXAMPLE 4

Example 1 was repeated except that 30% aqueous solutions of samples 11 to 14 were used instead of samples 1 to 5. The results are shown in Table 4.

TABLE 4

| Run No. | Control 4-1 | Invention 4-2 | 4-3 | 4-4 | 4-4 |
|---|---|---|---|---|---|
| Sample | Sample A | Sample 11 | Sample 12 | Sample 13 | Sample 14 |
| Sulfonating agent (mole %,*) | | | | | |
| Aminomethanesulfonic acid | – | 20 | 70 | – | – |
| Anilinesulfonic acid | – | – | – | 10 | 30 |

TABLE 4-continued

| Run No. | Control 4-1 | Invention 4-2 | 4-3 | 4-4 | 4-4 |
|---|---|---|---|---|---|
| Immediately after dispersion | | | | | |
| Slurry viscosity | >20,000 | 1300 | 1120 | 1020 | 1150 |
| Flowability | X | O | O | O | O |
| After standing for one day | | | | | |
| Stability | – | O | O | O | O |

*: Proportion based on the maleic anhydride portion of the copolymer.

What is claimed is:

1. A composition comprising an aqueous coal slurry having a viscosity of up to about 1400 centipoises and containing 50 to 90% by weight of coal and 0.3 to 1 parts by weight, per 100 parts by weight of coal, of a dispersant which is a water-soluble salt of a polymeric substance having a sulfonic acid residue bonded through an acid imide linkage or an acid amide linkage in the molecule.

2. The composition of claim 1 wherein the polymeric substance is a homopolymer or copolymer of a sulfonic acid-type monomer having a sulfonic acid residue.

3. The composition of claim 2 wherein the sulfonic acid-type monomer is an imide, half amide or amide of an unsaturated acid having a sulfonic acid residue.

4. The composition of claim 3 wherein the sulfonic acid residue is a sulfo group or a sulfonate group.

5. The composition of claim 3 wherein the unsaturated acid is an $\alpha,\beta$-unsaturated mono- or di-carboxylic acid.

6. The composition of claim 1 wherein the polymeric substance is a homopolymer or copolymer composed of 2 to 100 mole% of a sulfonic acid-type monomer, 0 to 98 mole% of an unsaturated carboxylic acid-type monomer and 0 to 90 mole% of another vinyl-type monomer.

7. The composition of claim 6 wherein the unsaturated carboxylic acid-type monomer is an $\alpha,\beta$-unsaturated dicarboxylic acid or its anyhydride.

8. The composition of claim 6 wherein the other vinyl-type monomer is an olefin, an unsaturated ester, an unsaturated ether, an unsaturated amide or an unsaturated nitrile.

9. The composition of claim 1 wherein the polymeric substance has a molecular weight of 500 to 100,000.

10. The composition of claim 1 wherein the water-soluble salt of the polymeric substance is an alkali metal salt, an alkaline earth metal salt, an ammonium salt or an amine salt.

11. A method for transporting coal which comprises transporting the coal in the form of an aqueous coal slurry containing from 50 to 90% by weight of coal and from about 0.3 to 1 part by weight, per 100 parts by weight of coal of a dispersant which is a water-soluble salt of a polymeric substance having a molecular weight of 500 to 100,000 and having a sulfonic acid residue bonded through an acid imide linkage or an acid amide linkage in the molecule.

* * * * *